US011484122B2

(12) United States Patent
Chen et al.

(10) Patent No.: US 11,484,122 B2
(45) Date of Patent: Nov. 1, 2022

(54) SOFA ARMREST CONNECTION STRUCTURE AND SOFA ASSEMBLY

(71) Applicant: Remacro Technology Co., Ltd., Jiangsu (CN)

(72) Inventors: Weiming Chen, Jiangsu (CN); Xiaohong Li, Jiangsu (CN)

(73) Assignee: Remacro Technology Co., Ltd., Suzhou (CN)

( * ) Notice: Subject to any disclaimer, the term of this patent is extended or adjusted under 35 U.S.C. 154(b) by 0 days.

(21) Appl. No.: 17/261,567

(22) PCT Filed: Oct. 20, 2020

(86) PCT No.: PCT/CN2020/122034
§ 371 (c)(1),
(2) Date: Jan. 19, 2021

(87) PCT Pub. No.: WO2021/184749
PCT Pub. Date: Sep. 23, 2021

(65) Prior Publication Data

US 2022/0104622 A1 Apr. 7, 2022

(30) Foreign Application Priority Data

Mar. 19, 2020 (CN) ..... 202020349329.X

(51) Int. Cl.
*A47C 4/02* (2006.01)
*A47C 13/00* (2006.01)
*A47C 17/02* (2006.01)

(52) U.S. Cl.
CPC ..... *A47C 4/02* (2013.01); *A47C 13/005* (2013.01); *A47C 17/02* (2013.01)

(58) Field of Classification Search
CPC .. A47C 4/021; A47C 4/02; A47C 7/30; A47C 13/005
See application file for complete search history.

(56) References Cited

U.S. PATENT DOCUMENTS 4,890,888 A * 1/1990 Kostin ..... B60N 2/68 297/440.21
6,241,317 B1 * 6/2001 Wu ..... A47C 4/02 297/440.1

(Continued)

FOREIGN PATENT DOCUMENTS

CN 203655818 U 6/2014
GB 2478823 A * 9/2011 ..... A47C 4/02

(Continued)

*Primary Examiner* — Timothy J Brindley

(57) ABSTRACT

The disclosure discloses a sofa armrest connection structure and a sofa assembly. The connection structure includes a first member and a second member, wherein the first member includes a first base plate, two guide rails symmetrically arranged on the first base plate, and a limiting part which is arranged on the first base plate and located under the two guide rails; the second member includes a second base plate and two guide bars symmetrically arranged on the second base plate; the two guide bars are in sliding insertion-fit with the two guide rails correspondingly; the first base plate and the second base plate are each provided with a plurality of bolt holes; the first base plate is used for being connected with a sofa seat frame, and the second base plate is used for being connected with a sofa armrest.

9 Claims, 3 Drawing Sheets

(56) References Cited

U.S. PATENT DOCUMENTS

| | | | | |
|---|---|---|---|---|
| 11,202,507 | B1 * | 12/2021 | Yi | F16B 12/40 |
| 2003/0011231 | A1 * | 1/2003 | Guillot | A47C 4/02 297/440.1 |
| 2005/0179303 | A1 * | 8/2005 | Owens | A47C 7/42 297/440.1 |
| 2006/0170272 | A1 * | 8/2006 | Mohn | A47C 7/30 297/452.6 |
| 2010/0254757 | A1 * | 10/2010 | Saul | F16B 12/20 403/404 |
| 2015/0285431 | A1 * | 10/2015 | Slusher, II | A47C 27/067 267/86 |
| 2017/0119162 | A1 * | 5/2017 | Bullard | A47C 7/30 |
| 2019/0219083 | A1 * | 7/2019 | Selle | F16B 12/125 |
| 2021/0068547 | A1 * | 3/2021 | Hodgson | A47C 7/42 |

FOREIGN PATENT DOCUMENTS

| | | | | |
|---|---|---|---|---|
| JP | 2002045255 | A * | 2/2002 | A47C 4/02 |
| WO | WO-2005027687 | A2 * | 3/2005 | A47C 13/005 |
| WO | WO-2016053709 | A1 * | 4/2016 | A47C 23/16 |
| WO | WO-2021184750 | A1 * | 9/2021 | |

* cited by examiner

SOFA ARMREST CONNECTION STRUCTURE AND SOFA ASSEMBLY

FIELD OF THE INVENTION

The disclosure relates to the technical field of furniture, in particular to a sofa armrest connection structure and a sofa assembly.

BACKGROUND OF THE INVENTION

Currently, fasteners such as bolts or screws are usually used to directly connect armrests of sofas with a main body on the market. When the sofa armrests are of a wooden structure, the sofa armrests cannot be disassembled after being connected to the main body, which is likely to cause inconvenient moving; when the sofa armrests are of a metal or plastic structure, it is necessary to form installation holes in the sofa armrests in advance, which is troublesome and requires high position accuracy of the hole system, and the position cannot be adjusted after installation, and the assembly flexibility is low.

SUMMARY OF INVENTION

In order to overcome at least one of the above-mentioned defects in the prior art, the disclosure provides a sofa armrest connection structure and a sofa assembly.

The technical solution adopted by the disclosure to solve the problems is:

a first aspect of the disclosure provides a sofa armrest connection structure, the connection structure includes a first member and a second member, the first member includes a first base plate, two guide rails symmetrically arranged on the first base plate, and a limiting part which is arranged on the first base plate and located under the two guide rails; the second member includes a second base plate and two guide bars symmetrically arranged on the second base plate; and the two guide bars are in sliding insertion-fit with the two guide rails correspondingly;

the first base plate and the second base plate are each provided with a plurality of bolt holes;

the first base plate is used for being connected with a sofa seat frame, and the second base plate is used for being connected with a sofa armrest;

alternatively, the first base plate is used for being connected with the sofa armrest, and the second base plate is used for being connected with the sofa seat frame.

According to the sofa armrest connection structure of the disclosure, after the two guide bars on the second member and the two guide rails on the first member are slidably inserted and fitted, there are two ways to fix the two members, one way is that the limiting part on the first member abuts against the two guide bars to limit sliding of the second member, so that the first member and the second member are connected; the other one is to align the bolt holes in the first base plate with the bolt holes in the second base plate, and then the first member and the second member are connected through bolts. It can be seen that by adopting the sofa armrest connection structure, assembly and disassembly of the sofa armrest are more convenient, while the assembly positions can be adjusted through the bolt holes, and thus the assembly flexibility of the sofa armrest is greatly improved.

Further, the first base plate is of the shape of a long strip plate, and the guide rails are of first bent structures formed by bending side edges of the first base plate toward one surface of the first base plate; the limiting part is of a second bent structure formed by bending a side edge, close to the end, of the first base plate toward one surface of the first base plate; and the first bent structures and the second bent structure are bent toward the same surface of the first base plate.

Further, the distance between the two guide rails gradually decreases along the axial direction of the first base plate.

Therefore, when the two guide bars are inserted into the two guide rails, the guide bars and the guide rails are more tightly matched, so that the assembly firmness of the sofa armrest is improved.

Further, the second base plate is also of the shape of a long strip plate, and the guide bars are of third bent structures formed by bending side edges of the second base plate toward one surface of the second base plate.

Further, the third bent structures are of the shape of "n".

Further, the distance between the two guide bars gradually decreases along the axial direction of the second base plate.

Therefore, when the two guide bars are inserted into the two guide rails, the guide bars and the guide rails are more tightly matched, so that the assembly firmness of the sofa armrest is improved.

A second aspect of the disclosure further provides a sofa assembly which includes the connection structures provided in the first aspect of the disclosure, a sofa seat frame and sofa armrests, wherein:

the sofa seat frame includes two symmetrically-arranged cross beams and two longitudinal beams connected with the two cross beams; and each longitudinal beam includes a first supporting plate and a first side plate arranged on one side of the first supporting plate; and first base plates are connected with the first side plates on the longitudinal beams, and second base plates are connected with the sofa armrests; alternatively, the first base plates are connected with the sofa armrests, and the second base plates are connected with the first side plates.

In summary, through the sofa armrest connection structure and the sofa assembly provided by the disclosure, assembly and disassembly of the sofa armrests are more convenient, while the assembly positions can be adjusted through the bolt holes, and thus the assembly flexibility of the sofa armrests is greatly improved.

Figure 1:
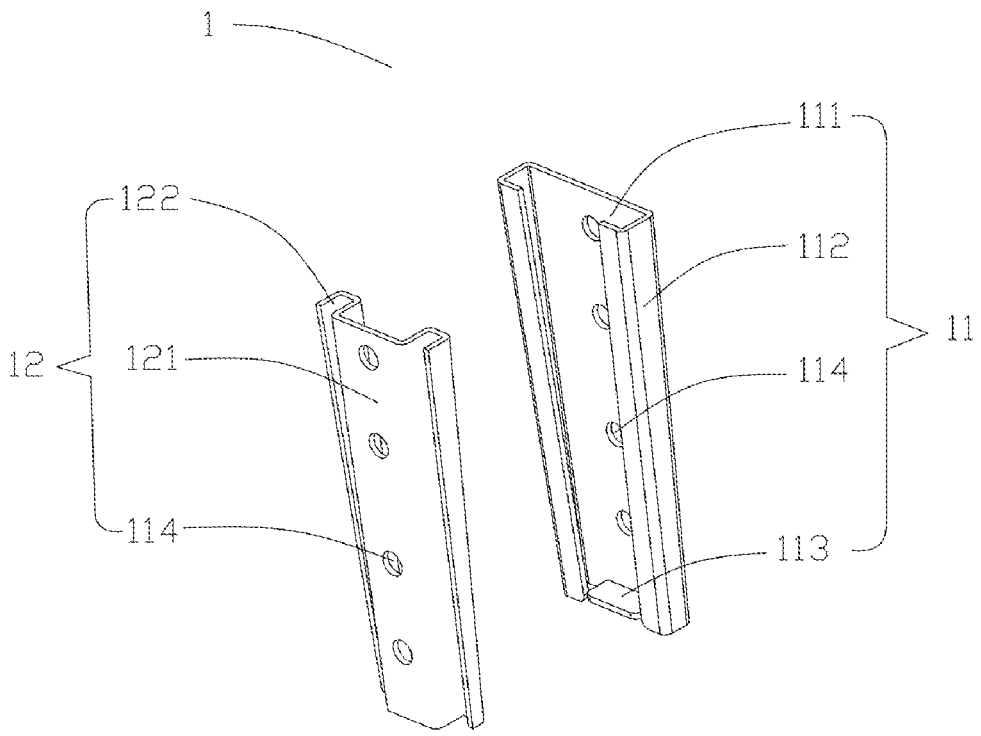
FIG. 1 is a schematic structural diagram of a sofa armrest connection structure according to Embodiment 1 of the disclosure.

Wherein, the reference numerals represent:

1, sofa armrest connection structure; 11, first member; 111, first base plate; 112, guide rails; 113, limiting part; 114, bolt holes; 12, second member; 121, second base plate; 122, guide bars; 2, sofa seat frame; 21, longitudinal beams; 211, first supporting plates; 212, first side plates; 22, cross beams; and 3, sofa armrests.

DETAILED DESCRIPTION OF THE ILLUSTRATED EMBODIMENTS

For a better understanding and implementation, the technical solutions in the embodiments of the disclosure will be described clearly and completely in conjunction with the accompanying drawings in the embodiments of the disclosure.

Unless otherwise defined, all technical and scientific terms used herein have the same meaning as commonly understood by those skilled in the technical field of the disclosure. The terms used in the description of the disclosure herein are only for the purpose of describing specific embodiments, and are not intended to limit the disclosure.

Embodiment 1

Referring to FIG. 1, the disclosure discloses a sofa armrest connection structure 1, the connection structure includes a first member 11 and a second member 12, and the first member 11 includes a first base plate 111, two guide rails 112 symmetrically arranged on the first base plate 111, and a limiting part 113 which is arranged on the first base plate 111 and located under the two guide rails 112; the second member 12 includes a second base plate 121 and two guide bars 122 symmetrically arranged on the second base plate 121; and the two guide bars 122 are in sliding insertion-fit with the two guide rails 112 correspondingly.

Wherein, the first base plate 111 is used for being connected with a sofa seat frame 2, the second base plate 121 is used for being connected with a sofa armrest 3; alternatively, the first base plate 111 is used for being connected with the sofa armrest 3, and the second base plate 121 is used for being connected with the sofa seat frame 2.

Specifically, the first base plate 111 is of the shape of a long strip plate, and the guide rails 112 are of first bent structures formed by bending side edges of the first base plate 111 toward one surface of the first base plate 111; the limiting part 113 is of a second bent structure formed by bending a side edge, close to the end, of the first base plate 111 toward one surface of the first base plate 111; and the first bent structures and the second bent structure are bent toward the same surface of the first base plate 111.

In this embodiment, the first bent structures are bent twice and are L-shaped; and the second bent structure is bent once. Indeed, the first bent structures and the second bent structure may also be of other shapes in other embodiments; and meanwhile, the two guide rails 112 may not be limited to be of integral bent structures, and may also be fixed to the first base plate 111 by welding.

Specifically, the second base plate 121 is also of the shape of a long strip plate, and the guide bars 122 are of third bent structures formed by bending side edges of the second base plate 121 toward one surface of the second base plate 121.

In this embodiment, the third bent structures are bent three times and are of the shape of "n"; indeed, the third bent structures may also be of other shapes in other embodiments. Meanwhile, the two guide bars 122 may not be limited to be of integral bent structures, and the two guide bars 122 may also be fixed to the second base plate 121 by welding.

In addition, the distance between the two guide rails 112 gradually decreases along the axial direction of the first base plate 111, and the distance between the two guide bars 122 gradually decreases along the axial direction of the second base plate 121. Thus, when the two guide bars 122 are inserted into the two guide rails 112, the guide bars and the guide rails are more tightly matched, and then the assembly stability of the sofa armrests 3 is improved.

Moreover, the first base plate 111 and the second base plate 121 are each provided with a plurality of bolt holes 114, and the plurality of bolt holes 114 are uniformly arranged along the axial directions of the first base plate 111 and the second base plate 121 respectively. The first member 11 and the second member 12 are positioned through the bolt holes 114, and are connected by bolts.

Therefore, there are two ways to fix the first member 11 and the second member 12 after sliding insertion-fit, one way is that the limiting part 113 on the first member 11 abuts against the two guide bars 122 to limit sliding of the second member 12, so that the first member 11 and the second member 12 are connected; the other one is to align the bolt holes 114 in the first base plate 111 with the bolt holes 114 in the second base plate 121, and then the first member 11 and the second member 12 are connected through bolts.

Embodiment 2

Figure 2:
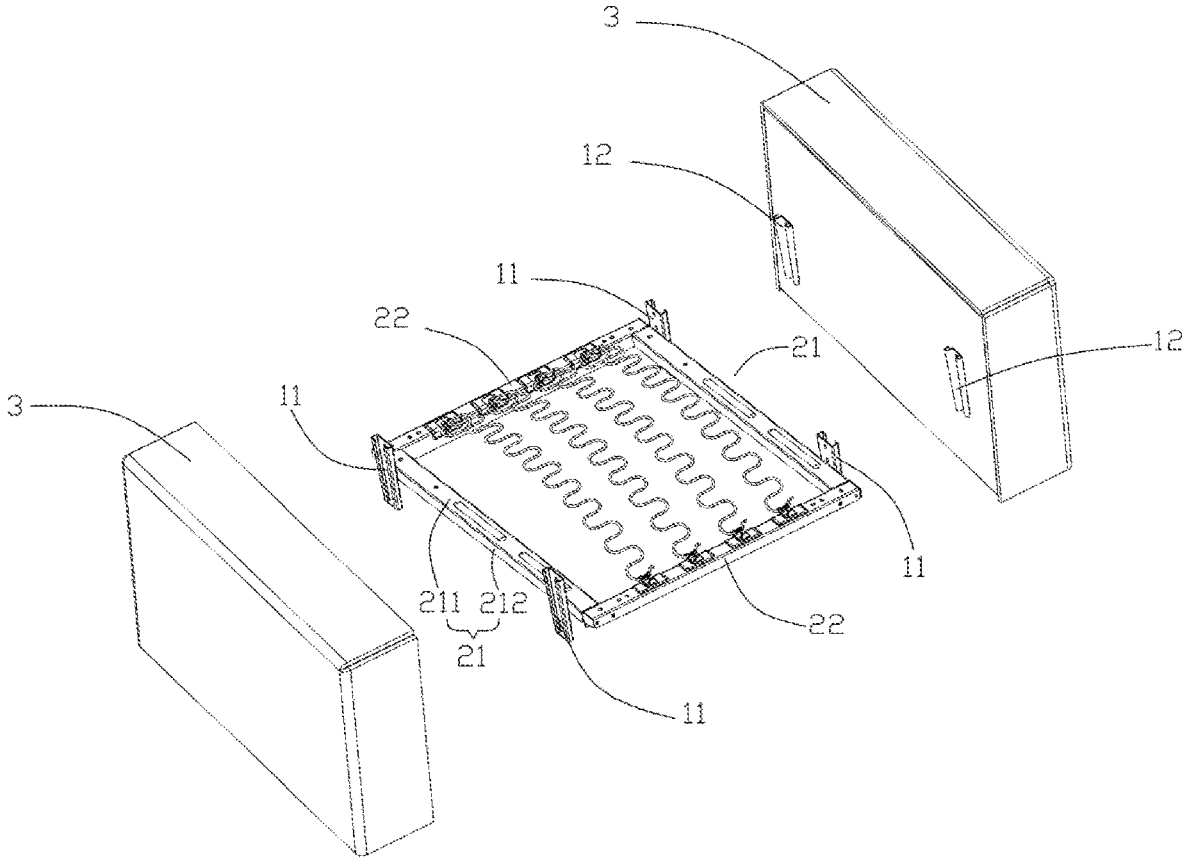
FIG. 2 is an exploded schematic diagram of a sofa assembly according to Embodiment 2 of the disclosure.
Figure 3:
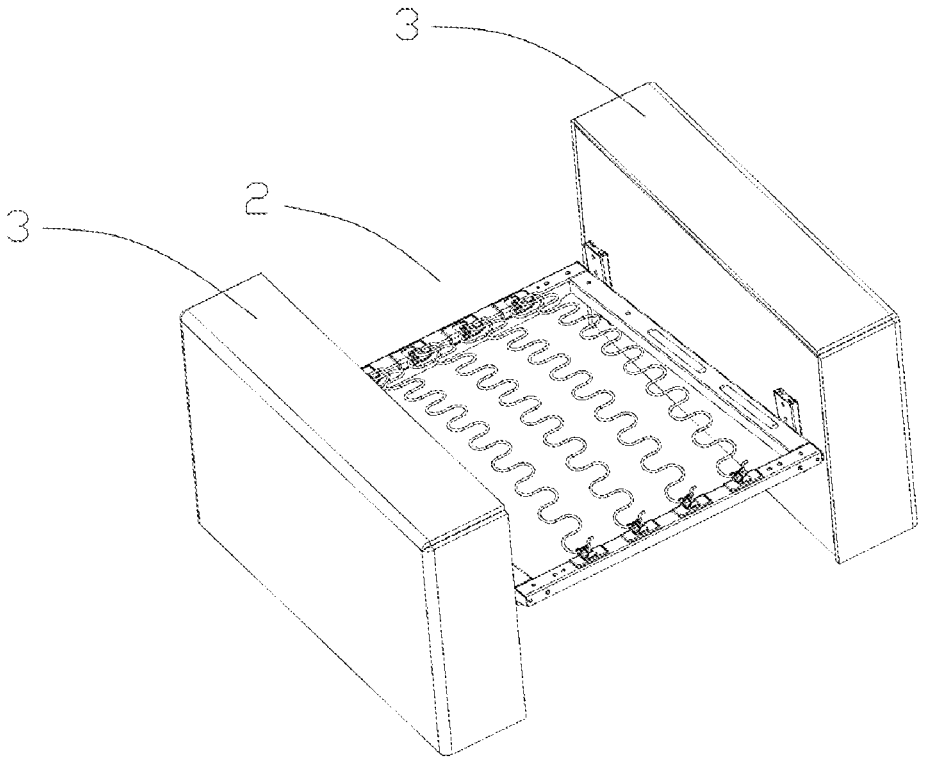
FIG. 3 is a schematic structural diagram of a sofa assembly according to Embodiment 2 of the disclosure.

Referring to FIGS. 2-3, the disclosure further provides a sofa assembly, and the sofa assembly includes sofa armrest connection structures 1, a sofa seat frame 2 and sofa armrests 3 in Embodiment 1. The sofa seat frame 2 includes two symmetrically-arranged cross beams 22 and two longitudinal beams 21 connected with the two cross beams 22; and each longitudinal beam 21 includes a first supporting plate 211 and a first side plate 212 arranged on one side of the first supporting plate 211.

In this embodiment, first base plates 111 are connected with the first side plates 212 on the longitudinal beams 21, and second base plates 121 are connected with the sofa armrests 3. Specifically, the first base plates 111 are fixed to the first side plates 212 by welding, and the second base plates 121 are fixed to the sofa armrests 3 by welding.

In summary, through the sofa armrest connection structure 1 and the sofa assembly provided by the disclosure, assembly and disassembly of the sofa armrests 3 are more convenient, while the assembly positions can be adjusted through the bolt holes 114, and thus the assembly flexibility of the sofa armrests 3 is greatly improved.

The technical means disclosed in the solutions of the disclosure are not limited to the technical means disclosed in the above-mentioned embodiments, but also include technical solutions composed of any combination of the above technical characteristics. It should be noted that those of ordinary skill in the art can make several improvements and modifications without departing from the principles of the disclosure, and these improvements and modifications are also deemed to fall within the protection scope of the disclosure.

The invention claimed is:

1. A sofa armrest connection structure, characterized by comprising a first member (11) and a second member (12), wherein the first member (11) comprises a first base plate (111), two guide rails (112) symmetrically arranged on the first base plate (111), and a limiting part (113) which is arranged on the first base plate (111) and located under the two guide rails (112); the second member (12) comprises a second base plate (121) and two guide bars (122) symmetrically arranged on the second base plate (121), and the two guide bars (122) are in sliding insertion-fit with the two guide rails (112) correspondingly;

the first base plate (111) and the second base plate (121) are each provided with a plurality of bolt holes (114);

the first base plate (111) is used for being connected with a sofa seat frame (2), and the second base plate (121) is used for being connected with a sofa armrest (3);

alternatively, the first base plate (111) is used for being connected with the sofa armrest (3), and the second base plate (121) is used for being connected with the sofa seat frame (2);

characterized in that the second base plate is also of a shape of a long strip plate, and the guide bars are of third bent structures formed by bending side edges of the second base plate toward one surface of the second base plate;

and the third bent structures are of the shape of "n".

2. The connection structure according to claim 1, characterized in that the first base plate (111) is of a shape of a long strip plate, and the guide rails (112) are of first bent structures formed by bending side edges of the first base plate (111) toward one surface of the first base plate (111); the limiting part (113) is of a second bent structure formed by bending a side edge, close to an end, of the first base plate (111) toward one surface of the first base plate (111); and the first bent structures and the second bent structure are bent toward a same surface of the first base plate (111).

3. The connection structure according to claim 1, characterized in that a distance between the two guide rails (112) gradually decreases along an axial direction of the first base plate (111).

4. The connection structure according to claim 1, characterized in that a distance between the two guide bars (122) gradually decreases along an axial direction of the second base plate (121).

5. A sofa assembly, characterized by comprising the sofa armrest connection structures (1) according to claim 1, a sofa seat frame (2) and sofa armrests (3), wherein:

the sofa seat frame (2) comprises two symmetrically-arranged cross beams (22) and two longitudinal beams (21) connected with the two cross beams (22); and each longitudinal beam (21) comprises a first supporting plate (211) and a first side plate (212) arranged on one side of the first supporting plate (211);

first base plates (111) are connected with the first side plates (212) on the longitudinal beams (21), and second base plates (121) are connected with the sofa armrests (3);

alternatively, the first base plates (111) are connected with the sofa armrests (3), and the second base plates (121) are connected with the first side plates (212) on the longitudinal beams (21).

6. A sofa assembly, characterized by comprising the sofa armrest connection structures (1) according to claim 2, a sofa seat frame (2) and sofa armrests (3), wherein:

the sofa seat frame (2) comprises two symmetrically-arranged cross beams (22) and two longitudinal beams (21) connected with the two cross beams (22); and each longitudinal beam (21) comprises a first supporting plate (211) and a first side plate (212) arranged on one side of the first supporting plate (211);

first base plates (111) are connected with the first side plates (212) on the longitudinal beams (21), and second base plates (121) are connected with the sofa armrests (3);

alternatively, the first base plates (111) are connected with the sofa armrests (3), and the second base plates (121) are connected with the first side plates (212) on the longitudinal beams (21).

7. A sofa assembly, characterized by comprising the sofa armrest connection structures (1) according to claim 3, a sofa seat frame (2) and sofa armrests (3), wherein:

the sofa seat frame (2) comprises two symmetrically-arranged cross beams (22) and two longitudinal beams (21) connected with the two cross beams (22); and each longitudinal beam (21) comprises a first supporting plate (211) and a first side plate (212) arranged on one side of the first supporting plate (211);

first base plates (111) are connected with the first side plates (212) on the longitudinal beams (21), and second base plates (121) are connected with the sofa armrests (3);

alternatively, the first base plates (111) are connected with the sofa armrests (3), and the second base plates (121) are connected with the first side plates (212) on the longitudinal beams (21).

8. A sofa assembly, characterized by comprising the sofa armrest connection structures (1) according to claim 1, a sofa seat frame (2) and sofa armrests (3), wherein:

the sofa seat frame (2) comprises two symmetrically-arranged cross beams (22) and two longitudinal beams (21) connected with the two cross beams (22); and each longitudinal beam (21) comprises a first supporting plate (211) and a first side plate (212) arranged on one side of the first supporting plate (211);

first base plates (111) are connected with the first side plates (212) on the longitudinal beams (21), and second base plates (121) are connected with the sofa armrests (3);

alternatively, the first base plates (111) are connected with the sofa armrests (3), and the second base plates (121) are connected with the first side plates (212) on the longitudinal beams (21).

9. A sofa assembly, characterized by comprising the sofa armrest connection structures (1) according to claim 4, a sofa seat frame (2) and sofa armrests (3), wherein:

the sofa seat frame (2) comprises two symmetrically-arranged cross beams (22) and two longitudinal beams (21) connected with the two cross beams (22); and each longitudinal beam (21) comprises a first supporting plate (211) and a first side plate (212) arranged on one side of the first supporting plate (211);

first base plates (111) are connected with the first side plates (212) on the longitudinal beams (21), and second base plates (121) are connected with the sofa armrests (3);

alternatively, the first base plates (111) are connected with the sofa armrests (3), and the second base plates (121) are connected with the first side plates (212) on the longitudinal beams (21).

* * * * *